US008232892B2

(12) United States Patent
Overholt et al.

(10) Patent No.: US 8,232,892 B2
(45) Date of Patent: Jul. 31, 2012

(54) METHOD AND SYSTEM FOR OPERATING A WELL SERVICE RIG

(75) Inventors: Mark Overholt, Medina, OH (US); Torrence Cambridge, Medina, OH (US); Mark Scott, Medina, OH (US)

(73) Assignee: Tiger General, LLC, Medina, OH (US)

( * ) Notice: Subject to any disclaimer, the term of this patent is extended or adjusted under 35 U.S.C. 154(b) by 479 days.

(21) Appl. No.: 12/627,457

(22) Filed: Nov. 30, 2009

(65) Prior Publication Data

US 2011/0128160 A1 Jun. 2, 2011

(51) Int. Cl.
*G01V 3/00* (2006.01)

(52) U.S. Cl. ..... 340/853.2; 340/853.1; 340/870.11; 340/854.6; 175/45; 175/61; 175/320; 175/73; 175/48; 324/369; 166/381; 166/292; 166/374; 166/372; 166/67; 702/188

(58) Field of Classification Search ..... 340/853.1, 340/853.2, 856.3, 870.11, 854.6; 175/125, 175/48, 45, 320, 61, 27, 73, 149, 85; 324/369; 702/6, 188; 166/381, 292, 67, 372, 374
See application file for complete search history.

(56) References Cited

U.S. PATENT DOCUMENTS

| | | | | |
|---|---|---|---|---|
| 3,942,594 | A | 3/1976 | Smith et al. | |
| 4,410,041 | A | 10/1983 | Davies et al. | |
| 4,989,671 | A | 2/1991 | Lamp | |
| 5,132,904 | A | 7/1992 | Lamp | |
| 6,497,281 | B2 | 12/2002 | Vann | |
| 6,923,273 | B2 | 8/2005 | Terry et al. | |
| 6,957,499 | B2 | 10/2005 | Roberts | |
| 7,172,038 | B2 | 2/2007 | Terry et al. | |
| 7,359,801 | B2 | 4/2008 | Newman | |
| 7,896,105 | B2 * | 3/2011 | Dupriest | 175/40 |
| 7,899,658 | B2 * | 3/2011 | Oliver et al. | 703/10 |
| 7,938,197 | B2 * | 5/2011 | Boone et al. | 175/27 |
| 7,946,356 | B2 * | 5/2011 | Koederitz et al. | 175/40 |
| 8,016,037 | B2 * | 9/2011 | Bloom et al. | 166/255.1 |
| 8,131,510 | B2 * | 3/2012 | Wingky et al. | 702/188 |
| 2007/0241931 | A1 * | 10/2007 | Compton et al. | 340/870.11 |
| 2011/0214878 | A1 * | 9/2011 | Bailey et al. | 166/369 |

* cited by examiner

*Primary Examiner* — Lam T Mai
(74) *Attorney, Agent, or Firm* — Hahn Loeser & Parks, LLP; Jason R. Strobel

(57) ABSTRACT

A system for automating service operations at a well includes a service rig having at least one input device, an engine connected to an engine electronic control unit having a engine controller area network, a plurality of crown sheeves, a cable, an output device, a communication infrastructure, and at least one of a computer and an operator station; at least one remote server in electronic communication with the communication infrastructure; and a web portal in electronic communication with the at least one remote server.

20 Claims, 8 Drawing Sheets

CURRENT DATE AND TIME: XXXX-XX-XX-XX:XX:XX
LAST LOGIN: XXXX-XX-XX-XX:XX:XX
LAST REPORT: XXXX-XX-XX-XX:XX:XX

FLEET TOTAL: 7
CURRENTLY ONLINE: 2

40

FLEET:

| STATUS | VEHICLE | MODEL | NAME | OWNER | CONNECTION CHANGE | INFO |
|---|---|---|---|---|---|---|
| | 1754123AT234 | TE155S | SEMI TRUCK | JAMES WILSON | XXXX-XX-XX-XX:XX:XX | i |
| | 1854352AT234 | AC155C | GIANT LIFTER | JOSH BRIANT | XXXX-XX-XX-XX:XX:XX | i |
| | 8974567QR231 | MODEL1 | NAME 1 | OWNER 1 | XXXX-XX-XX-XX:XX:XX | i |
| | 4554352AT567 | TE155S | NAME 2 | OWNER 2 | XXXX-XX-XX-XX:XX:XX | i |
| | 8754352AT321 | TE155S | NAME3 | JAMES WILSON | XXXX-XX-XX-XX:XX:XX | i |
| | 0954352AT654 | TE155S | NAME4 | JOSH BRIANT | XXXX-XX-XX-XX:XX:XX | i |
| | 2254352AT128 | TE155S | NAME5 | OWNER 1 | XXXX-XX-XX-XX:XX:XX | i |

FIG. 4

50

| | | | |
|---|---|---|---|
| CURRENT DATE AND TIME: | XXXX-XX-XX-XX:XX:XX | FLEET TOTAL: | 7 |
| LAST LOGIN: | XXXX-XX-XX-XX:XX:XX | CURRENTLY ONLINE: | 2 |
| LAST REPORT: | XXXX-XX-XX-XX:XX:XX | | |

CURRENT STATUS:

| RIG | | | ENGINE | | | RIG SETTINGS | | |
|---|---|---|---|---|---|---|---|---|
| DEPTH | 0 | METERS/FT. | RPM | 0 | MINUTE | DEPTH | 0 | METERS/FT. |
| SYSTEM | 0 | BAR/PSI | OIL PRESSURE | 0 | BAR/PSI | DEPTH 1 | 0 | BAR/PSI |
| GROSS LOAD | 0 | KG/LBS | COOLANT | 0 | °C/°F | DEPTH 2 | 0 | KG/LBS |
| CHARGE 1 | 0 | BAR/PSI | | | | DATA LOG 1 | 0 | BAR/PSI |
| BALL VALVE TEMP. | 0 | °C/°F | | | | DATA LOG 2 | 0 | °C/°F |
| LINE SPEED | 0 | M/MIN/ FT/MIN | | | | NET LOAD | 0 | M/MIN/ FT/MIN |
| TOTAL CABLE | 0 | METERS/FT | | | | LOAD 1 % | 0 | METERS/FT |
| NET LOAD | 0 | KG/LBS | | | | LOAD 2 % | 0 | KG/LBS |
| CHARGE 2 | 0 | BAR/PSI | | | | CABLE 1 | 0 | BAR/PSI |
| LOOP TEMP | 0 | °C/°F | | | | CABLE 2 | 0 | °C/°F |
| WELL 1 | 0 | BAR/PSI | | | | CHASSIS 1 | 0 | BAR/PSI |
| WELL 2 | 0 | BAR/PSI | | | | CHASSIS 2 | 0 | BAR/PSI |
| | | | | | | RIG 1 | 0 | |
| | | | | | | RIG 2 | 0 | |
| | | | | | | AUTO SCRN | | |

FIG. 5

60

CURRENT DATE AND TIME: XXXX-XX-XX-XX:XX:XX
LAST LOGIN: XXXX-XX-XX-XX:XX:XX
LAST REPORT: XXXX-XX-XX-XX:XX:XX

FLEET TOTAL: 7
CURRENTLY ONLINE: 2

OWNER DATA

CUSTOMER INFORMATION

| | |
|---|---|
| CUSTOMER NAME: | XYZ COMPANY |
| JOB NAME: | JOB 1 |
| ADDRESS: | 100 STREET AVE. |
| CITY, STATE, ZIP: | MEDINA, OH 43444 |
| JOB NUMBER: | 2004-1986 |
| DATE SERVICE DONE: | MM/DD/YYYY |
| INVOICE DATE: | MM/DD/YYYY |
| INVOICE NUMBER: | 16507 |

TRUCK INFORMATION/ SETUP

| | | |
|---|---|---|
| CABLE SIZE: | 9 16-6X7 | |
| CABLE WEIGHT: | 0.4800 | /FT |
| TOOL WEIGHT: | 250.00 | |
| LBS. PER FLUID GALLON: | 10.00 | |
| TRUCK: CALCULATED WEIGHT: | 9.8000 | |
| TRUCK: ACTUAL WEIGHT: | 8.0000 | |
| DIFFERENCE OF: | 1.8000 | |
| REVISED CABLE WEIGHT: | 8.3000 | /FT, CAL |

FIG. 6

CURRENT DATE AND TIME: XXXX-XX-XX-XX:XX:XX
LAST LOGIN: XXXX-XX-XX-XX:XX:XX
LAST REPORT: XXXX-XX-XX-XX:XX:XX

FLEET TOTAL: 7
CURRENTLY ONLINE: 2

70

ENGINEERING DATA

| D-MMM-YY | DAY | TIME | DEPTH | WEIGHT-GROSS | WEIGHT-NET | WEIGHT-PEAK | RUN TIME | CLOCK | RATE |
|---|---|---|---|---|---|---|---|---|---|
| 1 | D-MM-YY | 13:55:46 | 1803.3 | 1530 | 1224 | 1529 | 0 | 0 | 0 |
| 2 | D-MM-YY | 13:55:51 | 1803.3 | 1530 | 1222 | 1530 | 5 | 5 | 361 |
| 3 | D-MM-YY | 13:55:56 | 1803.5 | 1527 | 1222 | 1530 | 10 | 10 | 180 |
| 4 | D-MM-YY | 13:56:01 | 1803.3 | 1529 | 1223 | 1530 | 15 | 15 | 120 |
| 5 | D-MM-YY | 13:56:06 | 1803.5 | 1529 | 1222 | 1530 | 20 | 20 | 90 |
| 6 | D-MM-YY | 13:56:11 | 1803.4 | 1529 | 1223 | 1530 | 25 | 25 | 72 |
| 7 | D-MM-YY | 13:56:16 | 1803.6 | 1527 | 1222 | 1530 | 30 | 30 | 60 |
| 8 | D-MM-YY | 13:56:21 | 1803.4 | 1528 | 1222 | 1530 | 35 | 35 | 52 |
| 9 | D-MM-YY | 13:56:26 | 1803.5 | 1527 | 1222 | 1530 | 40 | 40 | 45 |
| 10 | D-MM-YY | 13:56:31 | 1803.3 | 1529 | 1222 | 1530 | 45 | 45 | 40 |
| 11 | D-MM-YY | 13:56:36 | 1803.5 | 1528 | 1222 | 1530 | 50 | 50 | 36 |
| 12 | D-MM-YY | 13:56:41 | 1803.3 | 1528 | 1223 | 1530 | 55 | 55 | 33 |
| 13 | D-MM-YY | 13:56:46 | 1803.5 | 1530 | 1223 | 1530 | 60 | 60 | 30 |
| 14 | D-MM-YY | 13:56:51 | 1803.5 | 1530 | 1224 | 1530 | 65 | 65 | 28 |
| 15 | D-MM-YY | 13:56:56 | 1803.4 | 1528 | 1223 | 1530 | 70 | 70 | 26 |
| 16 | D-MM-YY | 13:57:01 | 1803.5 | 1527 | 1223 | 1530 | 75 | 75 | 24 |
| 17 | D-MM-YY | 13:57:06 | 1803.3 | 1528 | 1223 | 1530 | 80 | 80 | 23 |
| 18 | D-MM-YY | 13:57:11 | 1803.5 | 1530 | 1222 | 1530 | 85 | 85 | 21 |

AVERAGE FT/MIN: 67.00

DEPTH REACHED: 1803.6

FIG. 7

METHOD AND SYSTEM FOR OPERATING A WELL SERVICE RIG

TECHNICAL FIELD

The present invention relates generally to a method and system of servicing an oil or gas well, and more particularly to a method and system for monitoring, automating, controlling, and recording swabbing operations during on-site servicing of a well.

BACKGROUND OF THE INVENTION

Oil and gas wells require maintenance on a routine basis in order to keep the wells operating at maximum capacity. Maintenance of an oil or gas well is performed on an as needed basis depending on the geographical location, physical properties, previous maintenance history, and type of well. The type of maintenance required for a particular well depends on the down hole conditions in the oil or gas well. For example, certain characteristics allow water to flow into the oil or gas well bore. Removal of excess water from the well bore allows the oil or gas to flow into the well bore. Water may build up in the well bore due to natural water levels in the geographical area around the well or from water that is pumped into the well during the well drilling and fracturing process. Water is removed through a process called "swabbing." Swabbing a well ensures maximum performance and maximum output of oil or gas from the well.

Generally, swabbing operations are conducted using truck mounted swabbing or service rigs. Service rigs may also be known as double-drum rigs or workover rigs, but such devices will be referred to generally throughout the application as service rigs. The service rigs may have a hydrostatically driven winch, which an operator may use to lower various tools into oil wells. Swabbing is performed by lowering swab mandrels into the well bore to the level of water in the well bore, and then subsequently into and below the water surface level. It is universally accepted to try to remove about six barrels of fluid during every swabbing operation. Each cycle of lowering the cable and tools into the well, collecting fluid from the well, and raising the cable and tools from the well by winding the cable with a winch is known as a run. The frequency with which a well is swabbed is dependent upon individual well characteristics, including the age of a well. For example, some wells may need to be swabbed weekly at which time a single barrel of fluid is removed. In another example, a well may need to be swabbed every six months, at which time ten barrels of fluid are removed.

During well maintenance and swabbing operations, information regarding depth of well, water level within the well, amount of water extracted, date and time of well service, as well as service rig operating data are observed. This information may be recorded for proof of service and to maintain a written record that enables a well owner to record the historical conditions of the well. Currently, data generated by the service rig is presently observed through various manual readouts during operation. However, the on-site rig operator may not accurately record the information or record the information at all. Generally, a well service operator performs manual calculations to arrive at a total volume of water removed from the well during well maintenance. Even though the manual calculations are performed, the accuracy of the information is not always guaranteed.

It is customary for a well owner to hire an outside contract agency to perform swabbing operations. A well owner may contract with a service rig provider to pull tubing from a well and contract with one or more service providers to provide other specific services in connection with the service rig company in order to rehabilitate the well according to the owner's direction. The well owner will then receive individual invoices for services rendered from each company involved in service or well maintenance. For example, a service rig operator may spend twenty hours at the well site and the well owner will be billed for the twenty hours or more of service. The well owner may not receive any detail as to the service operations in terms of when the work was started, completed, the speed of the operation, the amount of fluid removed from the well, or any problems that were encountered during service operations. In some instances, the well owner may be provided with a manual log of operations taken by hand from the rig operation, but the hand written notes may not be reliable, or recorded at all. The well owner has no indication of whether the service operations were done properly, or whether the well has been completely serviced. Also, a well owner that owns more than one well in a particular geographic location may not be able to properly identify which well was serviced. A well may be located in remote locations and the owner may not be able to physically visit the well sites. In this case, the well owner has no record of service operations, any problems with the well, or any accidents that occurs on-site during service operation.

As presently known, service and swabbing rigs do not have controls to shutdown operations when the service operations go out of a safe range. For example, the prior art service and swabbing rigs are unable to prevent "crown out" or overload by shutting down the swabbing operations when the system pressure or temperature go out of the normal range. In addition, the prior art rigs do not have multiple response scenarios to control rig operations based on all information gathered from the rig and service operations.

The present invention solves the problem of monitoring all information from the chassis and rig service operations in order to generate a multi-stage safety response and maintenance schedule based on the multiple inputs from the system. The present system and method can respond with multiple actions to assist the rig operator in safety and efficiency of service operations.

SUMMARY OF THE INVENTION

The present invention provides an improved method and system to perform service activities for maintenance and operation of an oil or gas well. In one embodiment, a method of automating service operations at a well comprises the steps of providing a service rig at the well having at least one input device, an engine connected to an engine electronic control unit having a engine controller area network, an output device, a communication infrastructure, and at least one of a computer and an operator station, wherein the at least one of a computer and an operator station contains a predetermined range of operational parameters; commencing service operations at the well; measuring data at the at least one input device in response to the service operations; converting the measured data into an electrical signal; transmitting the electrical signal from the input device to the controller area network; transmitting the electrical signal from the controller area network to the output device; transmitting the electrical signal from the output device to the at least one of a computer and an operator station via the communication infrastructure; converting the electrical signal into an operational parameter value; and comparing the operational parameter value to the predetermined range of operational parameters.

In another embodiment, a method of automating service operations at a well comprises the steps of providing a service rig at the well having at least one input device, an engine connected to an engine electronic control unit having a engine controller area network, an output device, a communication infrastructure, and a computer; commencing service operations at the well; measuring data at the at least one input device in response to the service operations; converting the measured data into an electrical signal; transmitting the electrical signal from the input device to the controller area network; transmitting the electrical signal from the controller area network to the output device; converting the electrical signal into an operational parameter value; transmitting the operational parameter value from the output device to a remote server via the communication infrastructure; and displaying the operational parameter value via a web portal.

In yet a further embodiment, a system for automating service operations at a well comprises a service rig including at least one input device, an engine connected to an engine electronic control unit having a engine controller area network, a plurality of crown sheeves, a cable, an output device, a communication infrastructure, and at least one of a computer and an operator station; at least one remote server in electronic communication with the communication infrastructure; and a web portal in electronic communication with the at least one remote server.

These and other objects of the present invention will become more readily apparent from a reading of the following detailed description taken in conjunction with the accompanying drawings wherein like reference numerals indicate similar parts, and with further reference to the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein:

FIG. 4 is a screen shot of a fleet report generated by the present system and method;

FIG. 5 is a screen shot of a customer report generated by the present system and method;

FIG. 6 is a screen shot of a status report generated by the present system and method;

FIG. 7 is a screen shot of a logging report generated by the present system and method.

DETAILED DESCRIPTION OF THE DRAWINGS

Figure 1:
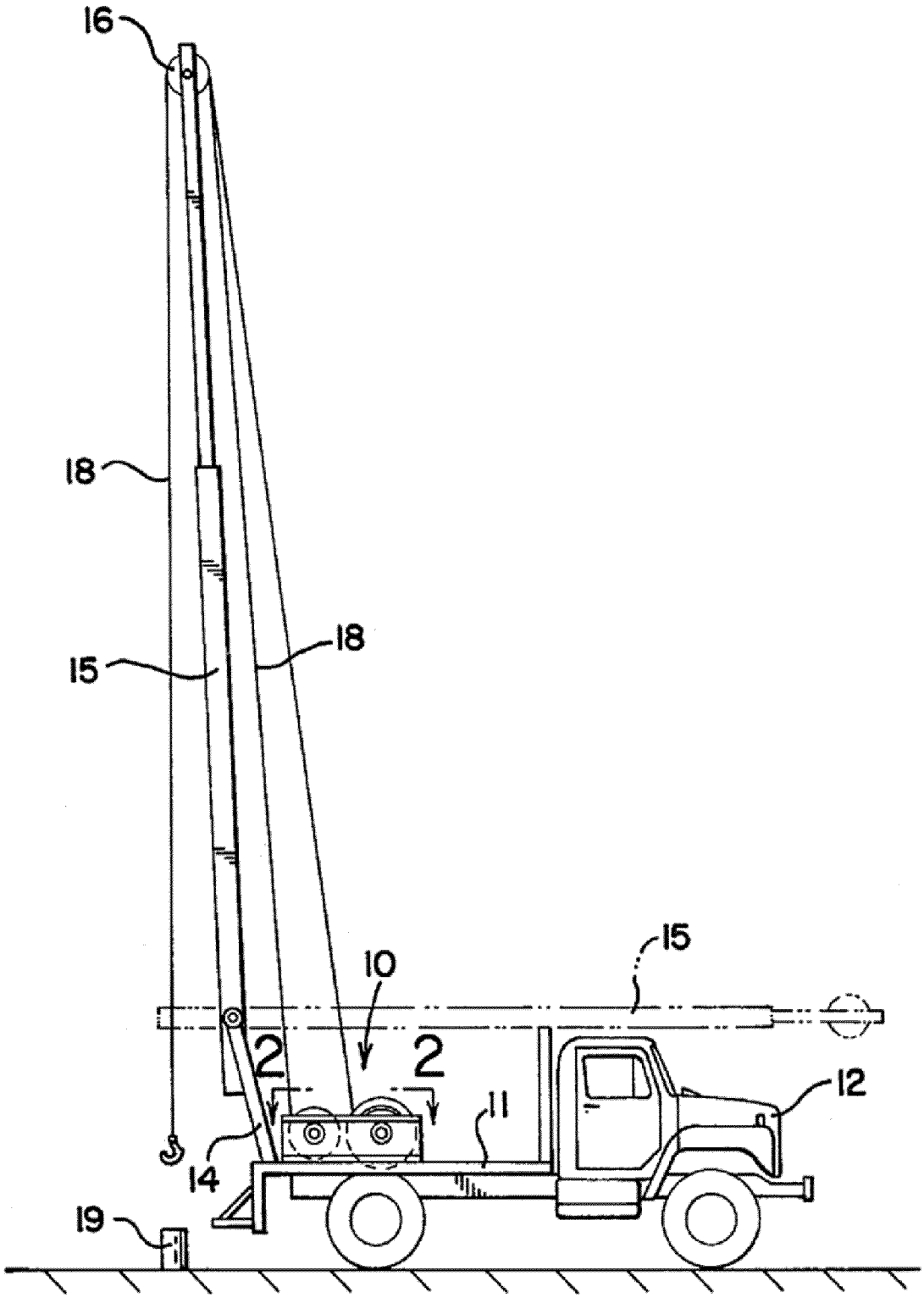
FIG. 1 is a side view of the service rig.

Referring now to the drawings wherein the showings are for purposes of illustrating embodiments of the invention only and not for purposes of limiting the same, the Figures show the components of the current method and system for servicing a well. The present invention relates to a process for automating well service operations through a method and system for collecting, transmitting, and analyzing data being generated by the well, service rig, and service operations.

Figure 2:
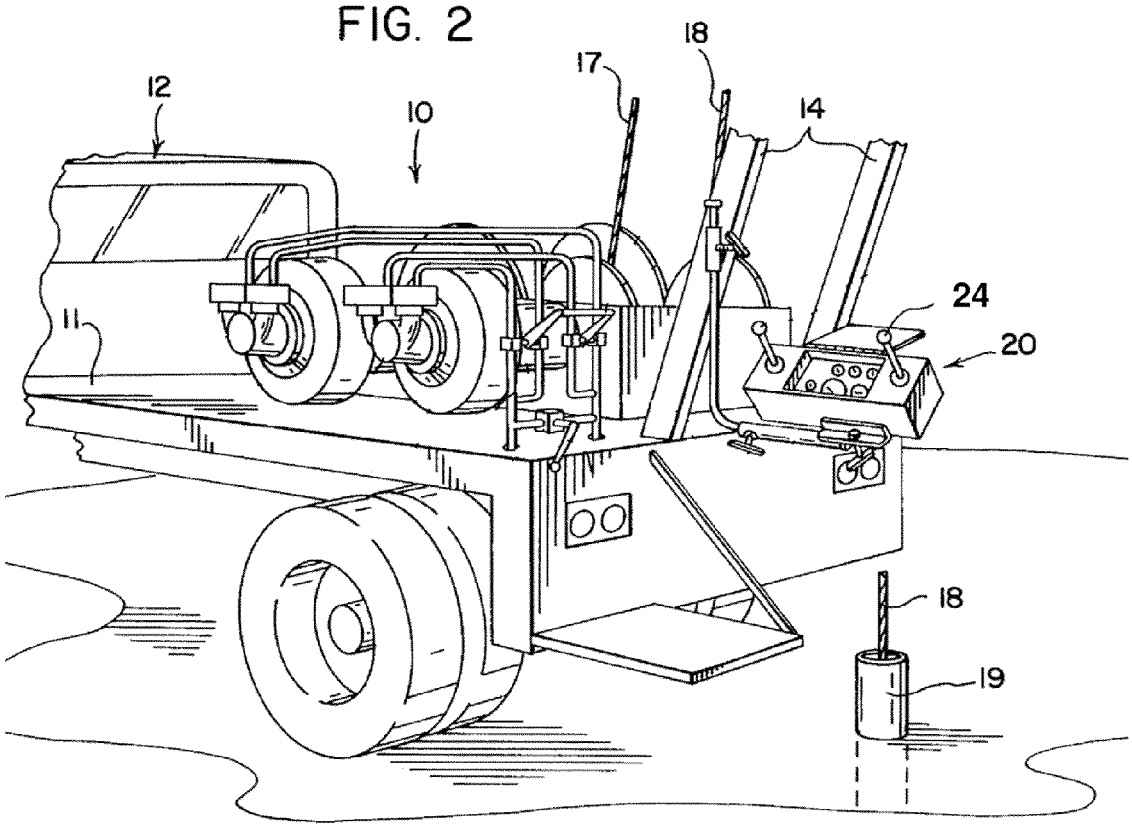
FIG. 2 is a perspective view of the rear of the rig shown in FIG. 1.

Referring to FIG. 1, a service rig 12 is shown to include a truck frame supported on wheels, which includes a direct drive dual drum line and cable winch, for operation and use by the system and components according to the invention, referred to generally by the numeral 10. Referring to FIGS. 1 and 2, winch 10 is securely mounted on a medial portion of deck 11 of truck 12. A stanchion 14 attached to rear portion of the deck 11 carries extendible well tending mast 15. The end of mast 15 carries rotatable crown sheeves 16 for positioning tubing cable 18 above well casing 19 of a well requiring maintenance or repair. In FIG. 1, truck 12 has been backed to well casing 19 and the mast 15 has been raised. As shown in FIG. 2, the service rig has been backed up to well casing 19 and the operator has adjusted the position of control panel 20 either in a horizontal, vertical or arcuate position so that working of tubing cable 18 and their tools or accessories, can be precisely and safely controlled. The operator will then use control panel 20 to start the truck engine, build up hydraulic pressure in the pump unit and observe the control instruments.

FIG. 2 shows how the operator will use the system 10 to raise or lower, by reeling in or reeling out, tubing cable 18 and tools. In one embodiment, the operator may move control handle 24 in an upward direction, thereby opening dual control valves, which in turn lowers tubing cable 18 into well casing 19. Once the tubing cable 18 has been lowered the desirable depth into the well casing 19, the operator may release control handle 24, thereby closing dual control valves and stopping the feed of tubing cable 18. In contrast, when the operator desires to withdraw cable 18 from well casing 19, control handle 24 may be moved into a downward direction, thereby opening dual control valves, which in turn raise tubing cable 18 from well casing 19.

The engine of the service rig 12 may be connected to a first electronic control unit having a controller area network system ("CAN"), the operation of which is described in SAE J1939, which is incorporated by reference herein. The hydraulic system of service rig 12 may be connected to a second electronic control unit having a controller area network. The electronic control units may receive information from one or more input devices 80. The input devices may be selected from the group comprising transducers, sensors, and switches. The input devices may be positioned at the crown sheeves 16, along the length of the cable 18, and in the well casings 19. The input devices are not limited to this particular arrangement and may be placed at any desired location from which a user desires to gather information. The input devices may collect data parameters from the service rig and convert the data, such as speed, position, temperature, acceleration, and pressure, into one or more electrical signals that are recognized by the controller area network. Once the data parameters are converted into electrical signals, the input devices may send the one or more signals to the CAN.

For the purpose of the present invention, the term "sensor" refers to any measuring or sensing device mounted on a vehicle or any of its components including new sensors mounted in conjunction with the diagnostic module in accordance with the invention. A partial, non-exclusive list of common sensors mounted on an automobile or truck is as follows: accelerometer; microphone; camera; antenna; capacitance sensor or other electromagnetic wave sensor; stress or strain sensor; pressure sensor; weight sensor; magnetic field sensor; coolant thermometer; oil pressure sensor; oil level sensor; air flow meter; voltmeter; ammeter; humidity sensor; engine knock sensor; oil turbidity sensor; throttle position sensor; steering wheel torque sensor; wheel speed sensor; tachometer; speedometer; other velocity sensors; other position or displacement sensors; oxygen sensor; yaw; pitch and roll angular sensors; clock; odometer; power steering pressure sensor; pollution sensor; fuel gauge; cabin thermometer; transmission fluid level sensor; gyroscopes or other angular rate sensors including yaw; pitch and roll rate sensors; coolant level sensor; transmission fluid turbidity sensor; break pressure sensor; tire pressure sensor; tire temperature sensor; tire acceleration sensor; GPS receiver; DGPS receiver; and coolant pressure sensor. The term "signal" herein refers to any time varying output from a component including electrical, acoustic, thermal, or electromagnetic radiation, or mechanical vibration.

Sensors on a vehicle may be generally designed to measure particular parameters of particular vehicle components. However, frequently these sensors also measure outputs from other vehicle components. In general, sensors provide a measurement of the state of the sensor, such as its velocity, acceleration, angular orientation or temperature, or a state of the location at which the sensor is mounted. Thus, measurements related to the state of the sensor may include measurements of the acceleration of the sensor, measurements of the temperature of the mounting location, as well as changes in the state of the sensor and rates of changes of the state of the sensor. As such, any described use or function of the sensors above is merely exemplary and is not intended to limit the form of the sensor or its function.

Figure 8:
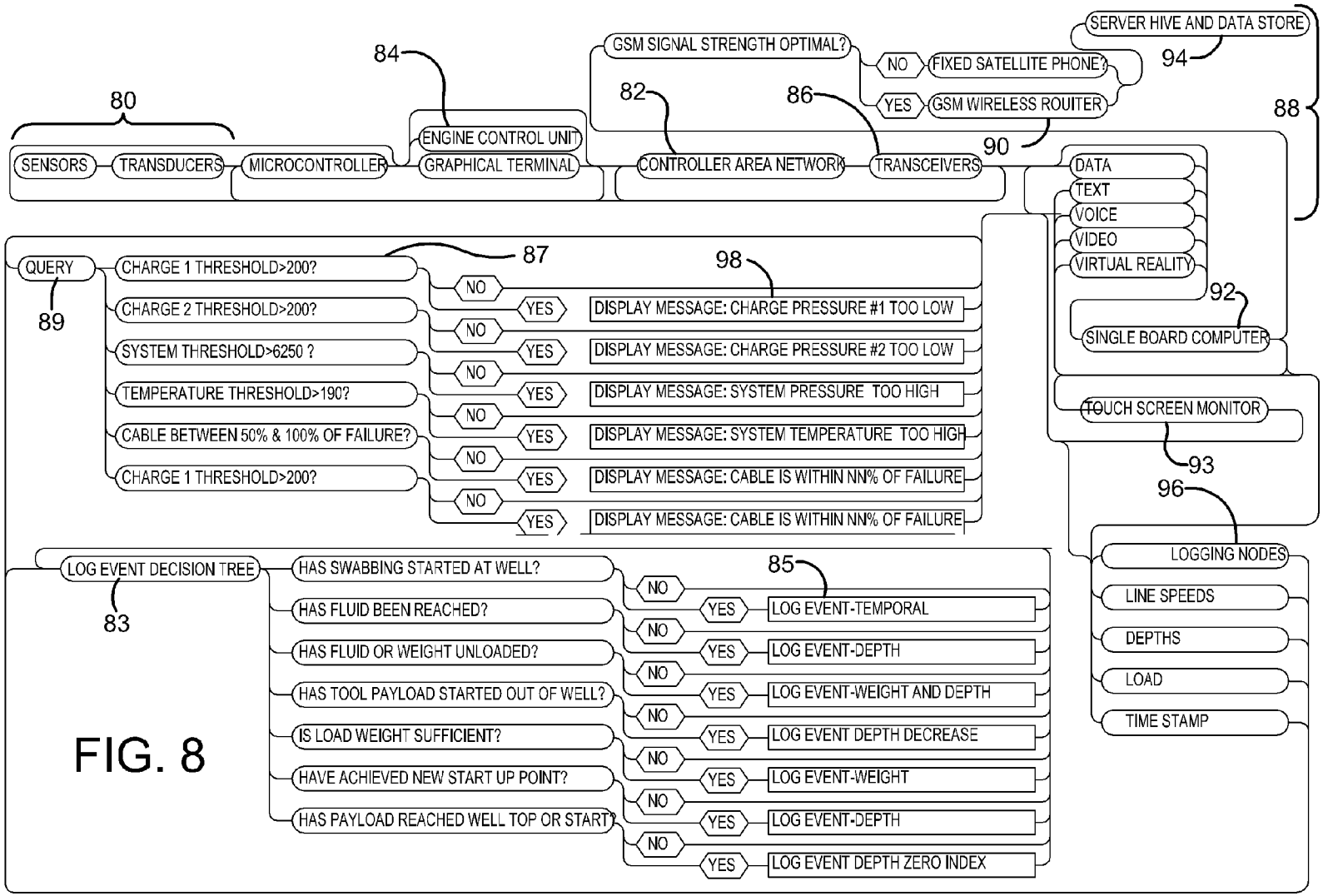
FIG. 8 is a flow chart diagram according to the present embodiment of the system and method.

As shown in the schematic in FIG. 8, input devices 80 may send one or more signals as defined above to the controller area network 82 ("CAN"), which may connect to one or more electronic control units 84 (ECU). Data from the input devices may be collected from the service rig, sent to the CAN system and captured by an output device such as a data logger transmitter and receiver 86 (DLTR). In one example, the DLTR 86 may be a Kvaser Lear Light HS Transceiver. Output data is generated, packaged and sent through the DLTR over a communication infrastructure 88. The communication infrastructure 88 may comprise wireless device 90, single board computer 92, and storage device 94.

Figure 3:
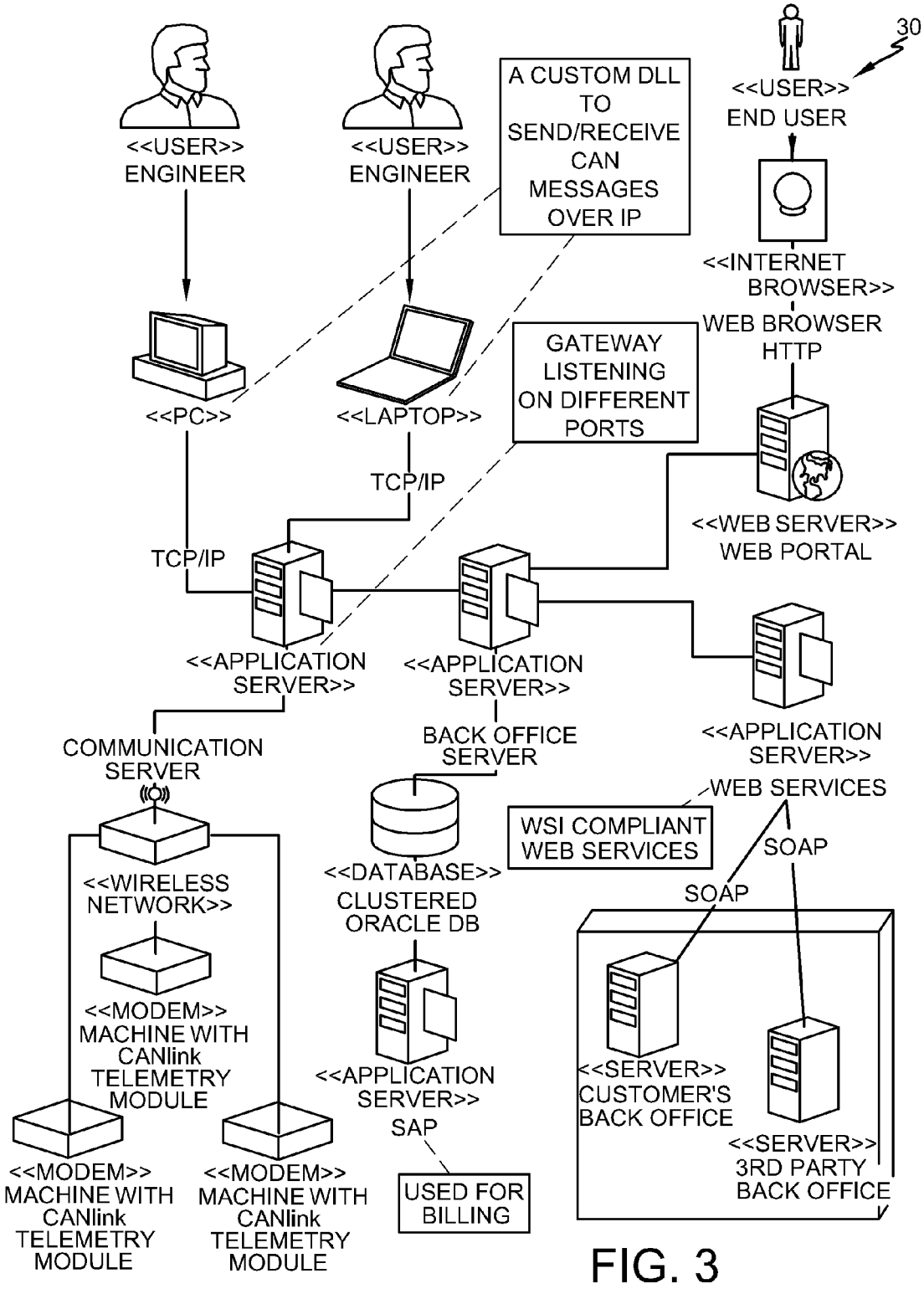
FIG. 3 is a functional block diagram of the communication infrastructure and storage device.

In one embodiment, the storage device 94 may be at least one server connected to DLTR 86 through a wireless network. The data from the input device may be sent through either a wireless network or landline telecommunication port to the server and may be accessed by a well owner or user through a web portal. The web portal may be accessed through internet communication system using a protocol such as TCP/IP. It is also envisioned that the user may also access the data through a customer server. In this situation, no internet access is necessary to view the data. As shown in FIG. 3, the present system and method may be arranged in an hierarchical system of architecture through one or more servers. The wireless device of the present embodiment may be a satellite connection or a global system for mobile telecommunications (GSM) wireless router. In one example, the wireless device for making the satellite connection may be made a GSP-2099-LP Fixed Satellite Phone. Additionally, the wireless device may be a Verizon-Linksys 80211.B to GSM Wireless Router.

The DLTR may generate one or more output signals and send the output signals to an operator station and/or computer that is accessed by the on-site well operator. The term "computer" used herein and below refers to any device for storing and/or possessing digital information. Examples of a computer include without limitation personal computers, PCs, desktop computers, laptop computers, notebook computers, PLCs (programmable logic controllers), data loggers, etc. In one example, the computer may be an EBX-855-G-1G-0 single board computer.

The input devices may measure any or all of the following parameters from the engine: engine functions, speed (rpm), water temperature, oil pressure, engine hours, hours to service, hydraulic system functions, charge pressure, system pressure, loop temperature, tank temperature, hours running when rear key on, hours to service. The input devices may detect any and/or all of the following parameters, for example, from the well casing: well depth, load sense pin data (gross and net loads), two well head pressure readouts, and system hours.

The following information may be collected through the input devices, the CAN system and ECU's for ultimate data collection: start time, time to bottom of well, depth to bottom (or depth before starting back out) of the well, time at the bottom of well, time at top of well, elapsed time start to finish per run, average feet per minute per run, load pulled, gross load, net load pulled, start net load, finish net load, total net barrels load lifted per well, sum of all runs (based on number of pounds per feet), total number of runs, starting casing pressure, starting tubing pressure, finish casing pressure, last run, finish tubing pressure, last run, calculated values.

The system and method of the present invention allows for real-time monitoring of service operations of a well through the use of a plurality of logging nodes 96 with user controlled feedback. As used in this application, real-time monitoring is defined to mean instantaneous monitoring. That is, a user monitoring the service operations at a well is able to obtain information regarding the service operations as soon as the services are performed. The time from occurrence of the service operation to a user being able to view the status of the service operation is only limited by the time it takes to transmit a signal from the service or swabbing rig to the user's monitoring interface and/or web portal. The logging nodes 96 are defined as data parameters collected from the input devices 80 and transmitted through the output device to the server system. The logging nodes include, but are not limited to parameters such as line speed; depth; load and time. FIG. 8 represents an exemplary method for determining the event of removing water from a well based on the logging nodes according to one exemplary embodiment of the present invention.

FIG. 8 shows a logical flowchart diagram illustrating an exemplary method for logging and recording the events at a service rig. The process begins at the input devices where the information may be transmitted from the controller area network to the output device and then to the server system. A log event decision tree 83 may be implemented to process the logging nodes. In one embodiment, the first log event may be whether swabbing has started at the well. If the answer is "YES" then the branch is followed to the log event "temporal." If the answer is "NO" then the branch is followed back to the log event decision tree. The second log event may be whether fluid has been reached in the well. If the answer is "YES" then the branch is followed to the log event "depth." If the answer is "NO" then the branch is followed back to the log event decision tree. The third log event may be whether fluid or weight has been unloaded. If the answer is "YES" then the branch is followed to the log event "weight and depth." If the answer is "NO" then the branch is followed back to the log event decision tree. The fourth log event may be whether the cable and tool payload has started out of the well. If the answer is "YES" the branch is followed to the log event "depth decrease." If the answer is "NO" then the branch is followed back to the log event decision tree. The fifth log event may be whether the load weight is insufficient. If the answer is "YES" then the branch is followed to log event "weight." If the answer is "NO" then the branch is followed to the log event decision tree. The sixth log event may be whether a new start up point has been achieved. If the answer is "YES" then the branch is followed to the log event "depth." If the answer is "NO" then the branch is followed back to the log event decision tree. The seventh log event may be whether the payload has reached the top of the well or starting point. If the answer is "YES" the branch is followed to the log event "depth zeroth index." If the answer is "NO" then the branch is followed back to the log event decision tree. The above log event decision tree events are illustrative and not limiting. Systems with either more or less events are within the scope of this disclosure.

The logging nodes may record information obtained during the one or more runs of the cable and tool as it is lowered into and out of the well. A run is defined as beginning at the time the tools and cable start down hole, and includes the time for the tools and cable to reach the bottom of the well, the residence time at the bottom of the well (or depth before starting back out), the time for the tools and cable to start out from the bottom of the well, and ends at the time the tools and cable reach the top of well. A subsequent run may be repeated and each step of the run may be recorded into the system. It is envisioned that the rig operator may view the service operations on the display as the information from the input device is transmitted to the computer.

The information obtained from each run may then be transmitted to the storage device and/or computer. Software loaded on the computer may then calculate the elapsed time from the start of a run to the finish of a run, and the average feet per minute for a run. Such calculation may be performed for each run. The calculated information may then be transmitted to the computer and storage system and displayed in one or more user-defined reports as shown in FIGS. 4-7.

The disclosed system and method may be used to monitor service rig operations as well as swabbing operations. Pre-programmed, customer specific information may be used to alert the rig operator of a change in service operation parameters. The pre-programmed customer specific information may include, without limitation, charge pressures, system pressures, system temperatures, and cable failure rate. In one embodiment, the rig operator may be able to view rig conditions in order to control service operations and as well as to observe any safety concerns. Alternatively or additionally, well safety operations may be monitored and/or controlled by the presently disclosed system and methods. The method may include a process to display one or more messages based on the logging nodes and service rig parameters. The input devices may collect information regarding well service operations and in addition may transmit that information to the server system. Additionally, the system may conduct a series of queries 89 that generate one or more messages to the display device as will be discussed below.

In one embodiment, the one or more queries 89 may be used to monitor the service rig operations and the service rig information obtained from the input devices. One or more messages 98 may be generated when any signal received by the computer is abnormal, outside a predetermined range, or exceeds a threshold value. The first query determines whether the charge pressures are within a predetermined operating range. If the first charge pressure is higher than the first charge threshold value, the control flow is answered in the negative "NO" and the system returns to the initial starting query. If the first charge pressure is equal to or lower than the first charge threshold value, the control flow is answered in the affirmative "YES" and message is displayed for the first charge pressure, based on the input device parameters and stored in the storage device. An example of the report is represented in FIGS. 4-7. The second query determines whether the second charge pressure is within a predetermined operating range. If the detected second charge pressure is higher than the second charge threshold value, the control flow goes to the initial query. If the second charge pressure is equal to or lower than the second charge threshold value, a message is displayed to the user interface and is also stored in the storage device.

The third query determines whether the system pressure is within a predetermined operating range. If the detected system pressure is higher than the system pressure threshold value, the control flow goes to the initial query. If the detected system pressure is equal to or lower than the system pressure threshold value, a message is displayed to the user interface and is also stored in the storage device. The fourth query determines the failure rate of the cable. If the detected failure rate is between the cable threshold value, the control flow goes to the initial query. If the detected failure rate is below the cable threshold value, a message is displayed to the user interface, and is also stored in the storage device.

The information from the service rig operations and swabbing operations may be transmitted to an output device that relays the information to a computer data storage system. The parameters displayed in conjunction with the display of the service rig operations and swabbing operations may be updated as these parameters are measured in real time by the sensors connected to the system.

The disclosed method is not limited to the order of steps described if such order or sequence does not alter the functionality of the method in an undesirable manner. That is, it is recognized that some steps may be performed before or after other steps or in parallel with other steps without departing from the scope and spirit of the present invention. It should be known by those of skill in the art that with the appropriate circuit, any number of inputs can be sampled and the data could be transmitted instantaneously upon receipt. In addition, a global positioning system (GPS) may be used to identify the geographic location of each service rig and well.

In operation, the well operator may load the pre-programmed customer specific information into the system. For example, the system may have information such as well geographic location, date of service operation, name of well, name of well owner, date of previous service operations, or any other information the well owner or operator deems desirable to properly service the well. In one embodiment, the service rig may arrive at the well site and position the service rig at the proper location at the well site. The service rig operator may then initiate the system and starts the service rig. The service rig system may begin by recording the date and time, and may then initiate the continuous monitoring function of engine and hydraulic parameters. The service rig operator may check and record well pressures and start depth. The cable and tools may then be lowered into the well as the system monitors the speed and load for each run and begins to perform the logging nodes as described above.

The present inventive process may record any and/or all well service operations and rig conditions during the service operations. As the cable and tools are lowered into the well, the system may record the time and depth of the first run. When the cable becomes slack, this typically indicates a pressure change and that the tool has reached liquid level in the well. The system may then record the time and depth at which the cable enters the fluid area in the well. The cable may continue to be lowered into the well and the system may record one or more depths. The operator may stop the cable and record each depth until the total depth is reached. The operator may then raise the cable and record loads, depth, and time for each run. The operator may end each run into and out of the well and record the time, volume, and depth of each run. The operator may perform additional cycles as required until the desired fluid amount has been removed from the well. Once the well service and/or swabbing operations have been completed, the operator may then record the pressure, stop the run sequence, and stop the system.

FIGS. 4-7 illustrate examples of the user definable reports that may be generated by the disclosed system and method. FIG. 4 is an example of a "fleet report" 40. In one embodiment, the fleet report 40 may display service rig information, including for example, vehicle identification number, vehicle model, vehicle name, well owner, and whether or not the vehicle is connected to the system. It is envisioned that when the rig operator logs in to the system from the fleet management page, the fleet report 40 may provide a of any and/or all rigs in the fleet. Alternatively or additionally, the fleet report 40 may allow a user to select a single rig (if desired) for successive information or detail. This column may contain either a small circular indicator or icon which may indicate whether the DLTR is currently connected to the system if the DLTR is offline. The second column may contain a vehicle identification number (VIN) or asset number, or other vehicle-specific identification information, which may be determined by the rig owner or provided thereto. Such vehicle identification information may be entered into the system at the time of purchase. The third column may contain, for example, the model of the rig, and which may be entered into the system by a system administrator or other individual have permission to enter such information. The fourth column may contain the name of the rig, and the fifth column may contain the name of the owner of the rig. As with other information related to a rig, this information may be entered into the system by a system administrator. Similarly, the sixth column may contain the most recent date that the rig was connected to the present system, and the seventh column may contain an icon to select the particular rig for viewing successive information on other web portal pages. In one embodiment, selection of an icon associated with a specific rig may transition to a status report 50 for a selected, specific rig, which is shown in FIG. 5.

FIG. 5 illustrates one example of status report 50 displaying the service rig information, which may include service operation variables, engine parameters, and service rig settings. This information maybe retrieved periodically from the rig by the CAN through the DLTR. In the event that a parameter is unavailable or has not been measured, the column may display "N/A" rather than a reported value.

The first column of FIG. 5 shows the current rig operational values which may change in response to operation of the rig. This operational information may be periodically broadcast over CAN by the ECU to the DLTR, may be requested by the DLTR at a predetermined frequency, or may be requested by the DLTR on demand. As depicted in FIG. 5, examples of measured rig operational values may include depth, system pressure, gross load, first charge pressure, ball valve temperature, line speed, total cable length, net load, second charge pressure, loop temperature, and well pressures. It is to be understood that fewer or additional rig operational values may be displayed in status report 50.

The second column of status report 50 in FIG. 5 shows current engine values which may change in response to operation of the engine. Engine value information may be periodically broadcast over CAN by the ECU to the DLTR, may be requested by the DLTR at a predetermined frequency, or may be requested by the DLTR on demand. As depicted in FIG. 5, examples of monitored engine values may include engine revolutions per minute, engine oil pressure, and coolant temperature. It is to be understood that fewer or additional engine values may be displayed in status report 50.

The third column of status report 50 shown in FIG. 5 depicts the current rig operational set points which may be assumed to be static in response to operation of the rig. This operational information may be transmitted over the CAN by the ECU to the DLTR with a predetermined frequency, in response to a set point change by the operator, or as requested by the DLTR. The comparison of the rig values to these set points may formulate the basis for threshold and range checks to determine proper operation of the rig. That is, rig operational values and engine values may be compared to rig operational set points to determine whether any of the rig operational values or engine values are outside of the predefined rig operational set points.

FIG. 6 illustrates customer report 60 showing the customer information and the service rig. In one embodiment, customer report 60 displays customer information in a first column and truck information/setup in a second column. The display customer information may include, for example, information related to a specific customer, a specific well, or a specific job. More specifically, such information may include, without limitation, customer name, job name, customer address, city, state, zip code, job number, date service done, invoice date, and invoice number. With regard to truck information/setup, it is envisioned that such information may include cable size, cable weight, tool weight, pounds per fluid gallon, calculated weight of the truck, actual weight of the truck, difference between the calculated and actual weight of the truck, and revised cable weight. Customer report 60 may permit a swabbing technician to enter customer specific information regarding a well to be swabbed into the system and to correlate such information to a rig provided for swabbing the identified well. In one embodiment, the swabbing technician may generate a hard copy of customer report 60, which may be subsequently presented as a receipt of work performed to the customer of the well which was swabbed. Alternatively or in addition, a swabbing technician may provide a customer with a job number, which in turn may permit customer to access customer report 60 through a web interface, rather than receiving a hard copy of customer report. It is also envisioned that customer report 60 may be provided to a customer upon completion of a swabbing operation using additional communication means such as email or text message. As can be appreciated, fewer or additional information may be provided in customer report 60, depending upon customer preference and availability of such information.

FIG. 7 shows an example of logging report 70, which may be generated from the one or more runs and may include data from multiple logging nodes. It is envisioned that logging report 70 may include data specific to a run, including without limitation run number, date, time of run, depth, gross weight of truck, net weight of truck, peak weight of truck, elapsed run time, initial clock value, and run rate. Additionally or alternatively, statistical data regarding a series of runs may be presented as part of logging report 70, and may include average feet per minute and maximum depth reached over a series of runs at a single well. It is envisioned that such data may be utilized by well swabbing companies to evaluate the work performed by swabbing technicians. Additionally, such data may be utilized by well owners to evaluate the service provided by well swabbing companies, as well as to evaluate the performance of wells at remote locations in the field.

A hard copy of logging report 70 may be generated by a swabbing technician after swabbing a well and presented to the customer as evidence of the work performed. It is also envisioned that a swabbing technician supervisor or customer may view such report via a web interface, or may receive such a report through other electronic means, including email and/or text message.

Wells may also pose the potential for accidents to occur or problems to arise based on the environmental conditions around the well and well casing, as well as the extreme operating conditions experienced by a rig when swabbing a well. For example, sour gas is created in certain well conditions and may be hazardous to the well operator. As discussed above in regards to FIG. 8, any number of display messages 98 may be generated through the current process. In one embodiment, safety events may be selected from engine, rig, or well parameters including, but not limited to, engine temperature, cable length, sour gas, or emergency stop. If the safety event is within a predetermined threshold value, the query is answered in the negative "NO" and the control flow returns to the start query. If the safety event is not within the predetermined threshold value, the query is answered in the affirmative "YES" and the control flow generates a display message to the user interface. The well operator can view the message and obtain real-time information regarding any parameters that are outside the predetermined threshold values. The message may also be sent to the storage device for recording well historical conditions and safety events.

In one embodiment, it is envisioned that rig 12 may be provided with an input device 80 which is designed to detect potentially hazardous levels of sour gas. As described above, input device 80 may convert the sour gas detection data into an electrical signal recognizable by CAN 82, which in turn may connect to ECU 84. DLTR 86 may receive output data from ECU 84, which data may by sent over a communication infrastructure 88 from DLTR 86 a computer display located at the well site. As such, well operator may be alerted to the sour gas condition, which may prompt one the well operator to perform one of several actions. Such an alert may be a visual alert on a computer display, an auditory alert, for example a siren or the horn of the rig sounding, other visual alerts including flashing lights on the rig, and any combination thereof. It is envisioned that well operator may choose to perform one or more actions, including evacuate the area to allow the build up of sour gas to dissipate, stop the swabbing operations and withdraw the tools from the well, and turn off the rig to prevent the possibility of explosion.

Alternatively or additionally, DLTR 86 may send an alert to a third party at a remote location, such as the headquarters for the swabbing company and/or to the local police department, fire department, and/or emergency services provider in the event that a sour gas condition is detected. As such, an individual at the headquarters of the swabbing company, for example, may place a phone call to or attempt to contact the well operator via additional methods to determine that the well operator has not been harmed by the sour gas situation.

In a further embodiment, it is envisioned that input device 80 may send a signal to a computer located on the rig in response to a which may automatically cause one or more actions to occur, depending upon the rig operational values and/or engine values. In one example, input device 80 may detect that the engine RPM value is exceeding a predetermined upper threshold, as the engine is engaged in strenuous activity. In response, the computer located on the rig may decrease the amount of fuel provided to the engine or may decrease the speed of withdrawal of the tools from the well to decrease the power requirement which much be supplied by the engine. As such, the engine may automatically resume operation below the upper threshold RPM value. It is also envisioned that the computer located on the rig may similarly respond to operational conditions outside predetermined thresholds other than engine RPM, and may in turn alter the operational parameters of the rig to ensure that such parameters return to values within the predetermined safe thresholds.

The best mode for carrying out the disclosure has been described for the purposes of illustrating the best mode known to the applicant at the time. The examples are illustrative only and not meant to limit the disclosure, as measured by the scope and spirit of the claims. The disclosure has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. A method of automating service operations at a well comprising the steps of:

providing a service rig at the well having at least one input device, an engine connected to an engine electronic control unit having a engine controller area network, an output device, a communication infrastructure, and at least one of a computer and an operator station, wherein the at least one of a computer and an operator station contains a predetermined range of operational parameters;

commencing service operations at the well;

measuring data at the at least one input device in response to the service operations;

converting the measured data into an electrical signal;

transmitting the electrical signal from the input device to the controller area network;

transmitting the electrical signal from the controller area network to the output device;

transmitting the electrical signal from the output device to the at least one of a computer and an operator station via the communication infrastructure;

converting the electrical signal into an operational parameter value; and comparing the operational parameter value to the predetermined range of operational parameters.

2. The method of claim 1, further comprising the step of:

altering an operational value of the rig in response to an operational parameter value outside of the predetermined range of operational parameters.

3. The method of claim 1, further comprising the step of:

providing an alert in response to an operational parameter value outside of the predetermined range of operational parameters.

4. The method of claim 3, wherein the alert is provided at the at least one of a computer and an operator station.

5. The method of claim 3, wherein the alert is at least one of an audio alert and a visual alert.

6. The method of claim 1, wherein the input device is selected from the group consisting of transducers, sensors, and switches.

7. The method of claim 1, wherein the output device is a data logger transmitter and receiver.

8. The method of claim 1, wherein the communication infrastructure includes a wireless device, a single board computer, and a storage device.

9. The method of claim 8, wherein the storage device is at least one server.

10. A method of automating service operations at a well comprising the steps of:

providing a service rig at the well having at least one input device, an engine connected to an engine electronic control unit having a engine controller area network, an output device, a communication infrastructure, and a computer;

commencing service operations at the well;

measuring data at the at least one input device in response to the service operations;

converting the measured data into an electrical signal;

transmitting the electrical signal from the input device to the controller area network;

transmitting the electrical signal from the controller area network to the output device;

converting the electrical signal into an operational parameter value;

transmitting the operational parameter value from the output device to a remote server via the communication infrastructure; and displaying the operational parameter value via a web portal.

11. The method of claim 10, wherein the at least one input device is selected from the group consisting of transducers, sensors, switches, and combinations thereof.

12. The method of claim 11, wherein the output device is a data logger transmitter and receiver.

13. The method of claim 10, wherein the communication infrastructure includes a wireless device, a single board computer, and a storage device.

14. The method of claim 13, wherein the storage device is at least one server.

15. The method of claim 14 further comprising the step of recording the operational parameter value at the remote server.

16. A system for automating service operations at a well comprising:

a service rig including at least one input device, an engine connected to an engine electronic control unit having a engine controller area network, a plurality of crown sheeves, a cable, an output device, a communication infrastructure, and at least one of a computer and an operator station;

at least one remote server in electronic communication with the communication infrastructure; and a web portal in electronic communication with the at least one remote server.

17. The system of claim 16, wherein the at least one input device is selected from the group consisting of transducers, sensors, switches, and combinations thereof.

18. The system of claim 16, wherein the at least one input device is positioned at least one of the crown sheeves, the cable, and the engine.

19. The system of claim 16, wherein the output device is a data logger transmitter and receiver.

20. The system of claim 16, wherein the communication infrastructure includes a wireless device, a single board computer, and a storage device.

* * * * *